US009752223B2

(12) United States Patent
Hazel et al.

(10) Patent No.: US 9,752,223 B2
(45) Date of Patent: Sep. 5, 2017

(54) EQUIPMENT FOR PLASMA SPRAY WITH LIQUID INJECTION

(71) Applicant: UNITED TECHNOLOGIES CORPORATION, Hartford, CT (US)

(72) Inventors: Brian T Hazel, Avon, CT (US); Joseph A DePalma, Feeding Hills, MA (US); Jessica L Serra, Vernon, CT (US); Henry H Thayer, Wethersfield, CT (US); Donn R Blankenship, Southbury, CT (US); Mario P Bochiechio, Vernon, CT (US); Paul H Zajchowski, Enfield, CT (US)

(73) Assignee: United Technologies Corporation, Farmington, CT (US)

( * ) Notice: Subject to any disclaimer, the term of this patent is extended or adjusted under 35 U.S.C. 154(b) by 97 days.

(21) Appl. No.: 14/643,009

(22) Filed: Mar. 10, 2015

(65) Prior Publication Data

US 2015/0252464 A1 Sep. 10, 2015

Related U.S. Application Data

(60) Provisional application No. 61/950,508, filed on Mar. 10, 2014.

(51) Int. Cl.

| | |
|---|---|
| ***C23C 4/12*** | (2016.01) |
| ***B05B 13/02*** | (2006.01) |
| ***C23C 4/134*** | (2016.01) |
| *B05C 5/00* | (2006.01) |
| *B05B 7/22* | (2006.01) |
| *B05B 13/04* | (2006.01) |

(52) U.S. Cl.

CPC ..... *C23C 4/127* (2013.01); *C23C 4/134* (2016.01); *B05B 7/22* (2013.01); *B05B 13/0228* (2013.01); *B05B 13/0257* (2013.01); *B05B 13/0431* (2013.01); *B05C 5/002* (2013.01)

(58) Field of Classification Search

None

See application file for complete search history.

(56) References Cited

U.S. PATENT DOCUMENTS

| | | | | |
|---|---|---|---|---|
| 5,186,718 | A * | 2/1993 | Tepman | H01L 21/67167 148/DIG. 169 |
| 5,609,921 | A | 3/1997 | Gitzhofer et al. | |
| 7,699,933 | B2 | 4/2010 | Lizenberg et al. | |
| 8,001,927 | B2 | 8/2011 | Dorier et al. | |
| 2003/0217811 | A1* | 11/2003 | Jeong | H01L 21/67751 156/345.31 |
| 2006/0222777 | A1 | 10/2006 | Skoog et al. | |
| 2006/0289405 | A1 | 12/2006 | Oberste-Berghaus et al. | |
| 2013/0157040 | A1 | 6/2013 | Petorak et al. | |
| 2013/0270355 | A1 | 10/2013 | Cotler et al. | |
| 2015/0140284 | A1* | 5/2015 | Mantkowski | F01D 25/005 428/195.1 |

* cited by examiner

*Primary Examiner* — Dah-Wei D Yuan
*Assistant Examiner* — Jethro M Pence
(74) *Attorney, Agent, or Firm* — Bachman & LaPointe, P.C.

(57) ABSTRACT

A plasma spray system including a turntable subsystem operable to position a multiple of work pieces on a respective multiple of workpiece mounts; a plasma spray subsystem operable to plasma spray the multiple of work pieces on said turntable subsystem; and an overspray wash subsystem operable to wash the multiple of work pieces on said turntable subsystem subsequent to plasma spray of the multiple of work pieces.

18 Claims, 5 Drawing Sheets

EQUIPMENT FOR PLASMA SPRAY WITH LIQUID INJECTION

CROSS REFERENCE TO RELATED APPLICATION

This application claims the benefit of provisional application Ser. No. 61/950,508, filed Mar. 10, 2014.

BACKGROUND

The present disclosure relates generally to plasma spraying and, more particularly, to equipment for plasma spraying with liquid injection.

Thermal barrier coatings (TBCs) have been widely used to protect the superalloy components in various industries, including components for gas turbine engines. Driven by higher inlet temperature requirements of modern gas turbine engines, high volume production of TBC components has attracted greater attention.

Plasma spray coating process such as Suspension Plasma Spray (SPS) and Solution Precursor Plasma Spray (SPPS) use fine particulates (~1 micron or less) or liquid solutions to produce the TBC. The TBC adheres to the underlying component primarily by mechanical forces and overspray is generated during the application process. The overspray may have a relatively weak bond with the component such that when additional coating is applied over the overspray, the component may exhibit diminished performance.

SUMMARY

A plasma spray system according to one disclosed non-limiting embodiment of the present disclosure includes a turntable subsystem operable to position a multiple of workpieces on a respective multiple of workpieces mounts; a plasma spray subsystem operable to plasma spray the multiple of workpieces on the turntable subsystem; and an overspray wash subsystem operable to wash the multiple of workpieces on the turntable subsystem subsequent to plasma spray of the multiple of workpieces.

A further embodiment of the present disclosure includes, wherein the overspray wash subsystem is downstream of the plasma spray subsystem by about thirty to three hundred and thirty (30-330) degrees of the turntable subsystem rotation.

A further embodiment of the present disclosure includes, wherein the turntable subsystem is rotatable about the central axis and each of the multiple of workpiece mounts are rotatable about a respective axis.

A further embodiment of the present disclosure includes a sun drive that rotates a removable saucer about the central axis and a planetary drive that selectively rotates the multiple of workpiece mounts.

A further embodiment of the present disclosure includes a deflector located about the central axis and within the multiple of workpiece mounts.

A further embodiment of the present disclosure includes, wherein the deflector is multi-sided A further embodiment of the present disclosure includes a wall collector adjacent to the turntable subsystem opposite the plasma spray subsystem.

A further embodiment of the present disclosure includes, wherein the overspray wash subsystem is operable to wash the multiple of workpieces with dry ice.

A further embodiment of the present disclosure includes, wherein the overspray wash subsystem is downstream of the plasma spray subsystem by about thirty to three hundred and thirty (30-330) degrees of the turntable subsystem rotation.

A further embodiment of the present disclosure includes a multiple of turntable subsystems.

A further embodiment of the present disclosure includes, wherein the plasma spray subsystem rotates between at least two of the multiple of turntable subsystems.

A plasma spray system, according to another disclosed non-limiting embodiment of the present disclosure includes a turntable subsystem operable to rotate a multiple of workpieces on a respective multiple of workpiece mounts, the turntable subsystem rotatable about a central axis and each of the multiple of workpiece mounts are rotatable about a respective axis; a plasma spray subsystem operable to plasma spray the multiple of workpieces on the turntable subsystem as the turntable subsystem rotates the multiple of workpieces about the central axis; and an overspray wash subsystem operable to wash the multiple of workpieces on the turntable subsystem subsequent to plasma spray of the multiple of workpieces, the overspray wash subsystem downstream of the plasma spray subsystem with respect to rotation of the turntable subsystem about the central axis.

A further embodiment of the present disclosure includes, wherein the overspray wash subsystem is operable to wash the multiple of workpieces with dry ice.

A further embodiment of the present disclosure includes, wherein the plasma spray subsystem rotates between at least two of a multiple of turntable subsystems.

A method of plasma spraying a multiple of workpieces according to another disclosed non-limiting embodiment of the present disclosure includes rotating a turntable subsystem with a multiple of workpieces on a respective multiple of workpiece mounts; plasma spraying the multiple of workpieces as the turntable subsystem rotates; and washing the multiple of workpieces as the turntable subsystem rotates.

A further embodiment of the present disclosure includes washing the multiple of workpieces as the turntable subsystem rotates with dry ice.

A further embodiment of the present disclosure includes stopping the turntable subsystem to rotate each of the respective multiple of workpiece mounts.

A further embodiment of the present disclosure includes cooling each of the multiple of workpieces as the turntable subsystem rotates.

A further embodiment of the present disclosure includes rotating the plasma spray subsystem between at least two of a multiple of turntable subsystems.

A further embodiment of the present disclosure includes loading/unloading at least one of the multiple of turntable subsystems while plasma spraying the multiple of workpieces of another of the multiple of turntable subsystems.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
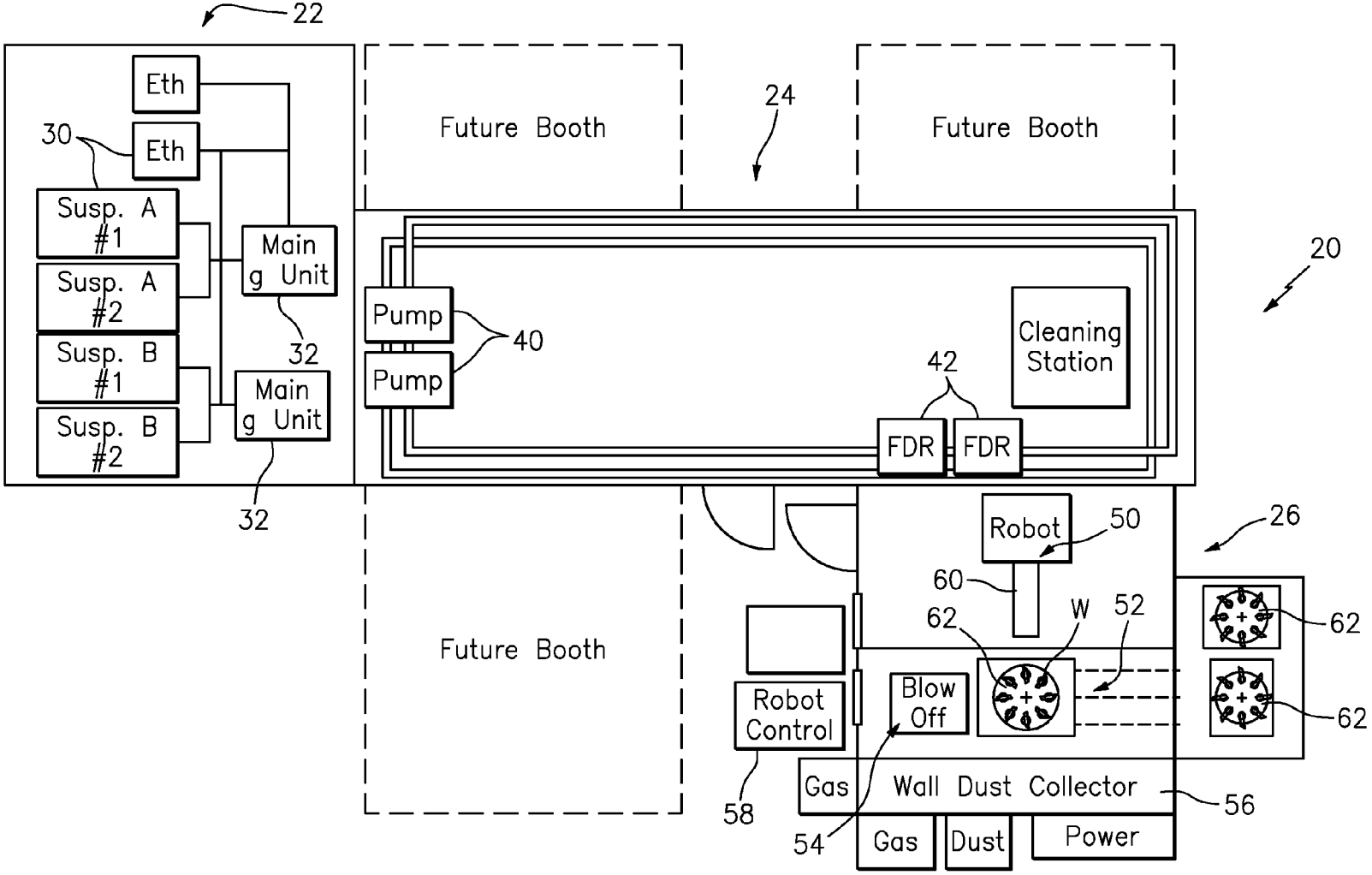
FIG. 1 is a schematic view of a plasma spray system architecture according to one disclosed non-limiting embodiment.

FIG. 1 schematically illustrates a plasma spray system 20 for a workpiece W. In various disclosed non-limiting embodiments, the workpiece W may include but not be limited to a component of a gas turbine engine, such as a turbine blade, turbine vane, blade outer air seal, combustor component. Other workpieces W that require a plasma coating are found in many industries and are not limited to those recited herein.

In various embodiments, the plasma coating may be deposited onto the workpiece W with a Suspension Plasma Spraying ("SPS") process. SPS involves dispersing a ceramic feedstock into a liquid suspension prior to injecting the ethanol based ceramic suspension feedstock into a plasma jet. The coating material may be deposited, for example, by a Solution Precursor Plasma Spray ("SPPS") process, in which a solution of coating precursors is atomized and injected into a direct current (DC) plasma jet. Various materials may be plasma sprayed onto the workpiece W and may include rare earth partially-stabilized zirconia (include hafnia as an alternate to zirconia), such as yttria-stabilized zirconia, a rare earth stabilized zirconia such as gadolinium stabilized zirconia or other material suitable for plasma spraying. It should be appreciated that the plasma spray system 20 can be used for other families of materials other than zirconates or hafnates to include but not be limited to silicates such as yttrium silicate, on titania, and on alumina as well as blended materials, either two dissimilar ceramics or a metallic and ceramic. In certain embodiments, the ceramic feedstock dispersed within the liquid suspension to form the coating may include fine ceramic particulates.

The plasma spray system 20 generally includes a suspension bay 22, a feeder bay 24 and at least one spray booth 26. It should be understood that various other arrangements as well as additional or alternative bays will also benefit herefrom. That is, the system 20 is modular to facilitate expansion and various arrangements.

The suspension bay 22 generally stores containers 30 of materials in a contained and safe space segregated within the plasma spray system 20. Although illustrated as two different materials in two different supplies it should be appreciated that any number of different material supplies will benefit herefrom. The materials stored within the suspension bay 22 may include an ethanol-based or water-based system for a plasma sprayed thermal barrier coating that includes, for example, Yttria-stabilized zirconia (YSZ) which is a zirconium-oxide based ceramic powder, Gadolinium zirconate (GdZ) and an Ethanol (Eth) carrier. The chemical materials may be, for example, fully premixed outside of this system into a single container or as separate parts in separate containers then mixed before communication to the feeder bay 24. The materials may be stored separately then mixed in mixing units 32 within the suspension bay 22, or alternatively, stored as premixed suspensions. The suspension bay 22 includes various safety systems such as a system to seal the containers and flush lines.

The feeder bay 24 generally includes, pumps 40 and a feeder system 42 for each of the at least one spray booth 26 to supply materials thereto and provide individual control of feeders, supply streams, and recipes. The feeder bay 24 also includes various safety systems such as a system to seal and flush the lines.

The spray booth 26 generally includes a plasma spray subsystem 50, a turntable subsystem 52, an overspray wash subsystem 54, a collection subsystem 56 and a control 58. It should be understood that various other architectures to receive various other workpieces will also benefit herefrom.

The plasma spray subsystem 50 include a robotic manipulated plasma spray torch 60 operated by the control 58. The plasma spray torch 60 such as that manufactured by Northwest Mettech Corp of North Vancouver BC Canada, Progressive Surface of Grand Rapids, Mich. USA, Sulzer of Winterthur Switzerland or others. The plasma spray torch 60 is operable to apply plasma spray suspensions or solutions supplied from the suspension bay 22 by the feeder bay 24. The plasma spray torch 60 may use axial, radial, and other combinations of injection modes to coat the workpieces W as the turntable subsystem 52 rotates to provide relatively high manufacturing rates at significant deposition efficiencies.

Figure 2:
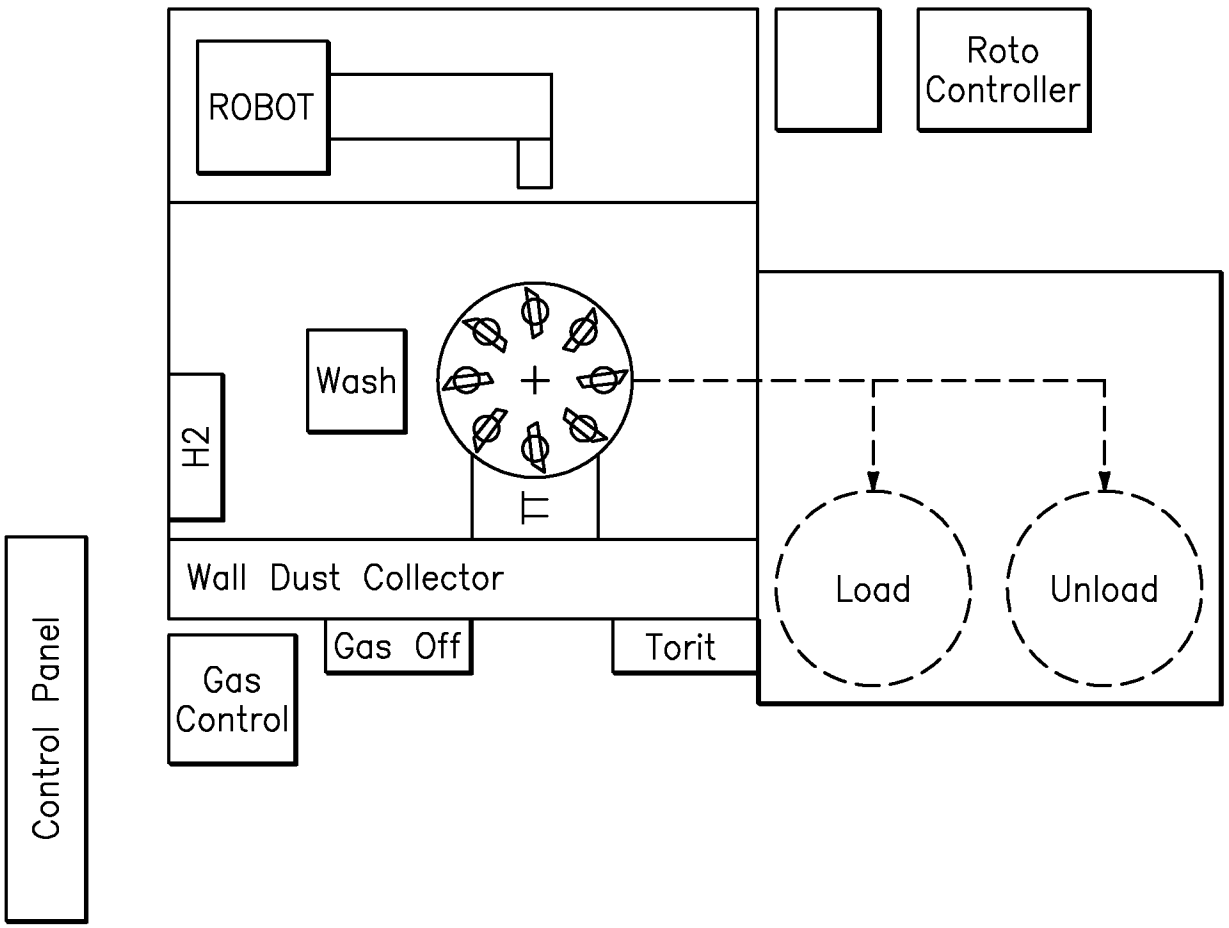
FIG. 2 is a schematic view of a spray booth of the plasma spray system according to another disclosed non-limiting embodiment.
Figure 3:
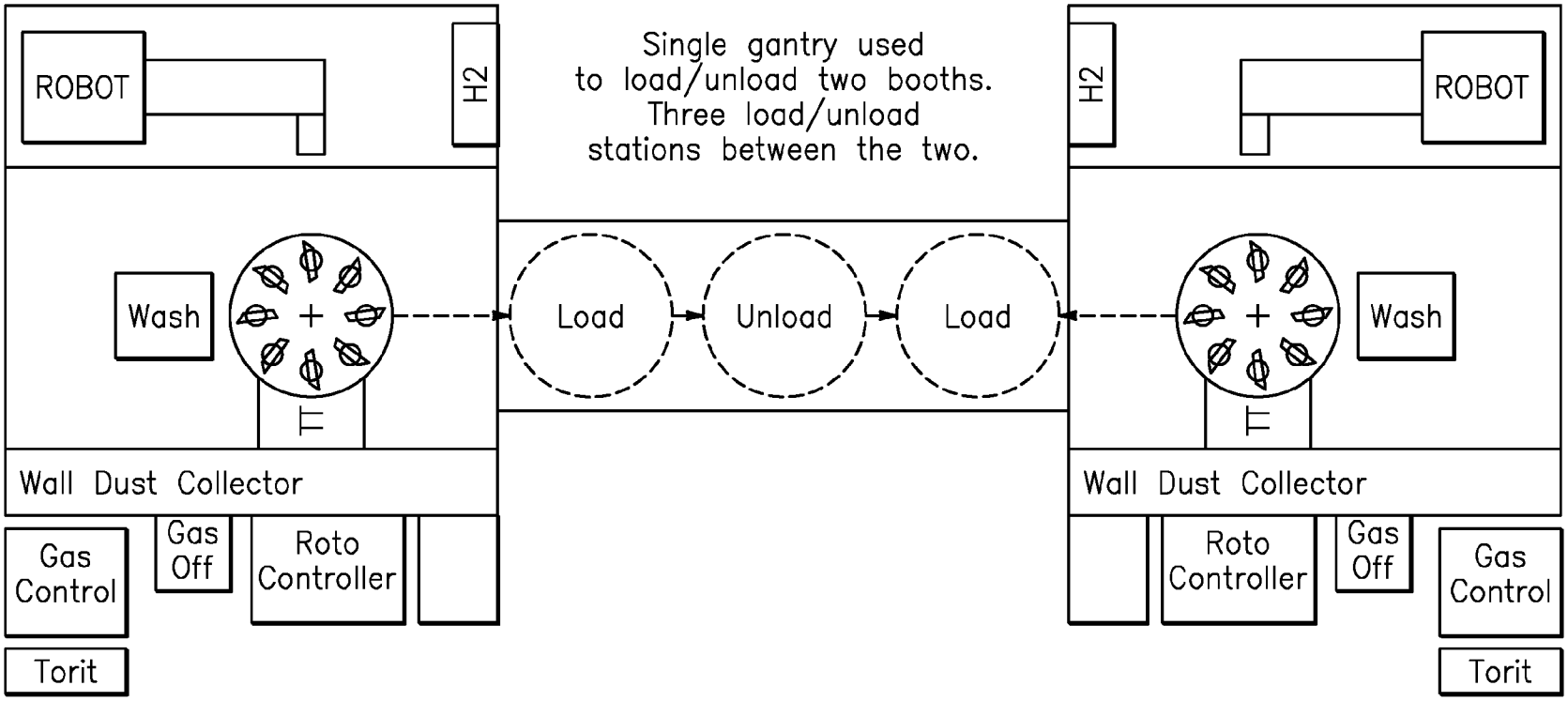
FIG. 3 is a schematic view of a spray booth of the plasma spray system according to another disclosed non-limiting embodiment.

The turntable subsystem 52 generally includes a multiple of turntables 62 (FIGS. 2, 3), each of which is operable to position the multiple of workpieces W with respect to the plasma spray torch 60. That is, one planetary turntable 62 supports the workpieces W for the plasma spray operation while one or more other turntables 62 undergo workpiece W load/unload operations. The plasma spray torch 60 is thereby essentially always in operation to maximize production capacity and efficiency. It should be appreciated that various alternative architectures will also benefit herefrom.

Figure 4:
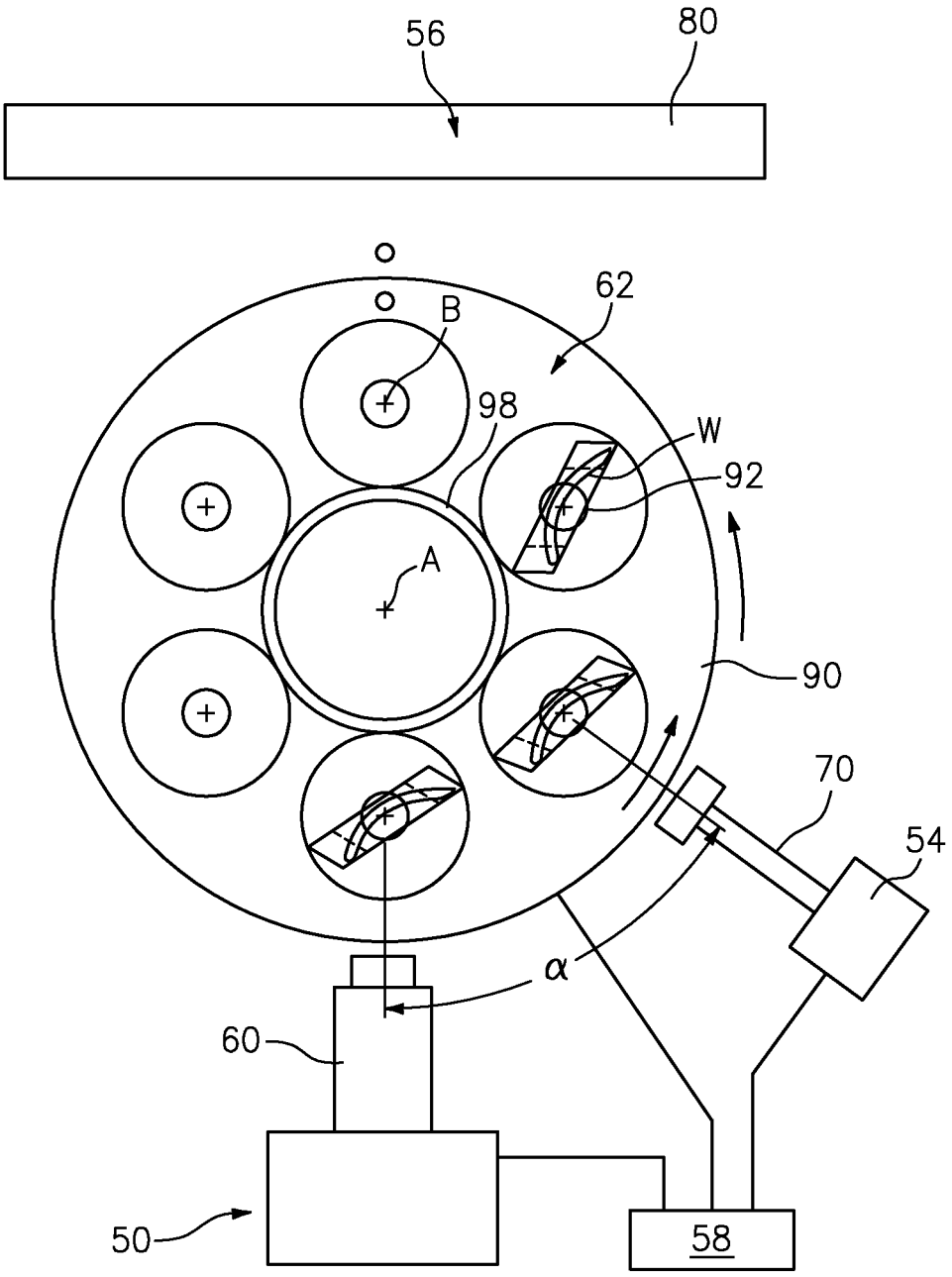
FIG. 4 is a schematic top view of a turntable subsystem of the plasma spray system.

With reference to FIG. 4, the overspray wash subsystem 54 is directed toward the workpieces W on the planetary turntable 62 that are undergoing the plasma spray operation to wash each of the multiple of workpieces W. The overspray wash subsystem 54 may be located generally at 90 or 270 degree, although any position between 30 and 330 degrees may be acceptable, with the plasma spray subsystem 50 at the zero degree position. During deposition of coating material by the plasma spray torch 60, overspray may be deposited onto the workpiece W. The overspray may be loosely adhered to workpiece W, and removal thereof is desirable prior to deposition of additional coating material in the area of overspray.

The overspray wash subsystem 54 operates in concert with the plasma spray torch 60 as the planetary turntable 62 rotates. In one disclosed non-limiting embodiment, the overspray wash subsystem 54 includes a robotic controlled wash sprayer 70 that moves in the X, Y and Z axes as operated by the control 58. The robotic controlled wash sprayer 70 in this disclosed non-limiting embodiment, sprays dry ice, a solid form of carbon dioxide that sublimates so as to avoid residue and contamination of the workpieces W. Alternatively, other substances may be sprayed to "wash" the workpieces W and thereby facilitate removal of the overspray from the plasma spray torch 60.

The spray booth 26 may alternatively or additionally include temperature control of the workpiece W. In one disclosed non-limiting embodiment, the turntable 62 size and speed are related to the plasma spray torch 60 so a desired workpiece W temperature is maintained. This may additionally be augmented with for example, cooling air via air nozzles around the periphery of the turntable 62 directed toward the workpieces W; cooling air through the turntable 62 and thence through the cooling channels of the workpieces W; cooling air nozzles mounted to the plasma spray torch 60 to align with the plasma jet to impact the workpieces W before or after the plasma jet; or combinations thereof. The air may be controlled by the control 58.

The collection subsystem 56 may include a wall collector 80 opposite the plasma spray torch 60 to facilitate collection of the overspray, dust and remnants thereof. The collection subsystem 56 thereby readily removes the micron sized powders generated by the plasma spray torch 60.

Figure 5:
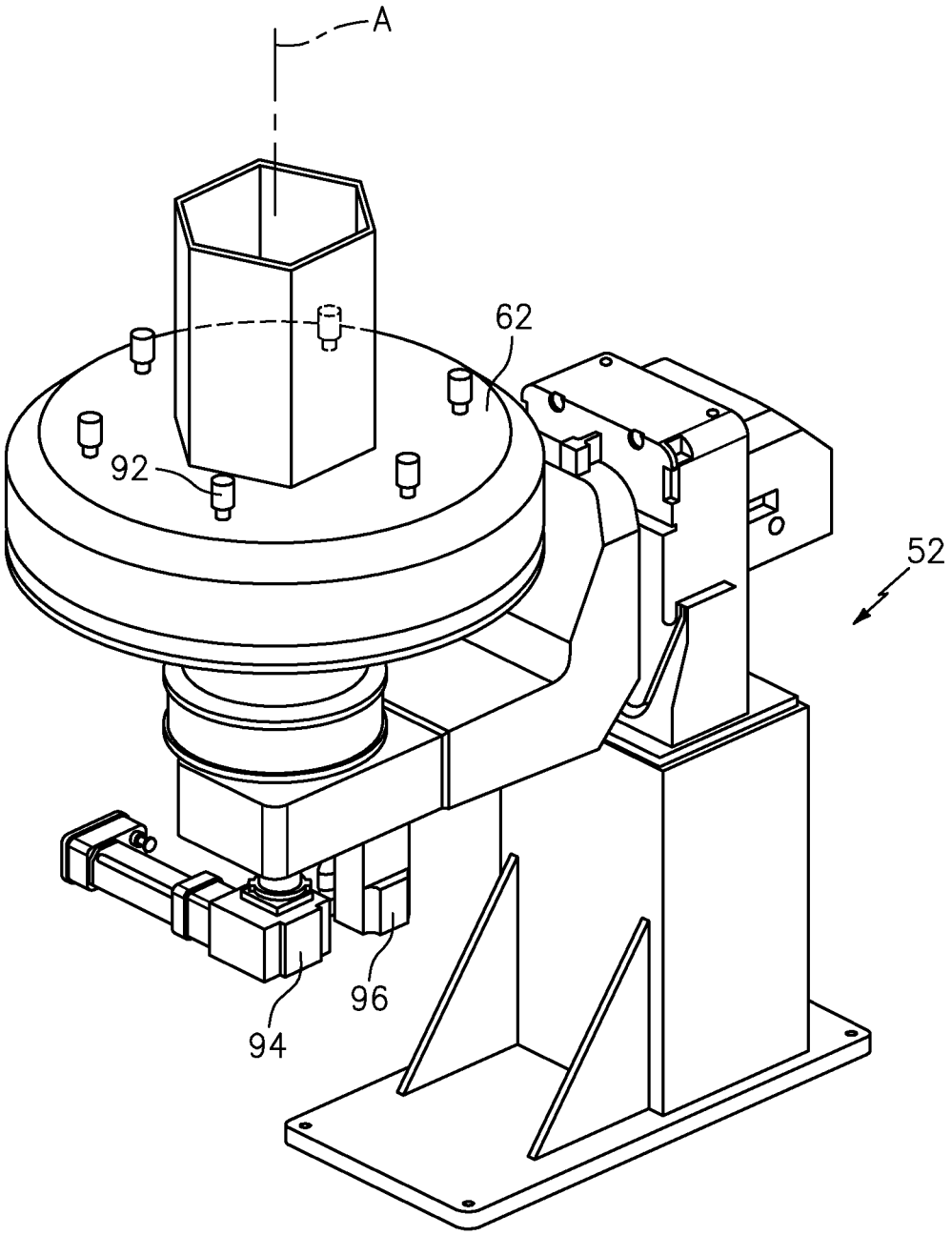
FIG. 5 is a perspective view of a turntable subsystem of the plasma spray system.

Each planetary turntable 62 may include removable saucer 90 that is rotatable about a central axis A and a multiple of workpiece mounts 92, each of which is rotatable about its own mount axis B that are operated by the control 58. The planetary turntable 62 provides selective planetary motion to each individual workpiece W mounted to the workpiece mounts 92. That is, the planetary turntable 62 includes a sun drive 94 that rotates the saucer 90 about the central axis A and a planetary drive 96 that selectively rotates the multiple of workpiece mounts 92 (FIG. 5). The planetary turntable 62 may include various other arrangements as well as additional or alternative features such as cooling systems will also benefit herefrom. The saucer 90 may be removable to protect the drives 94, 96 and allow replacement as the coating builds up thereon over time.

A deflector 98 located about the central axis A within the ring of the workpiece mounts 92. A deflector 98, shown as a cylinder, is located about the central axis A within the ring of the workpiece mounts 92. Alternatively, the deflector 98 may be multi sided to coincide with the number of workpiece positions on the turntable 62. For example the deflector 98 may be hexagonal in cross-section for a six workpiece turntable 62. The deflector 98 primarily prevents deposition on workpiece other than the one directly in front of the plasma spray torch 60. The deflector 98 may also operate as part of the collection subsystem 56 with an exhaust therefrom such that powders are passed into the deflector then exhausted upwards therefrom.

In one disclosed non-limiting embodiment, the planetary turntable 62 rotates at about thirty (30) rpm as the plasma spray torch 60 sprays the workpieces W. As the planetary turntable 62 rotates, the control 58 operates the plasma spray torch 60 to spray the workpieces as each is rotated past. Then, the planetary turntable 62 is stopped and the planetary drive 96 rotates each of the workpiece mounts 92 such as between a pressure side and a suction side of an airfoil such that the other side may be coated. The plasma spray torch 60 may be selectively directed toward the wall collector 80 while the workpiece mounts 92 are repositioned to maintain operational production speeds. It should be appreciated that the control 58 may provide other control sequencers for coordinated operation of the plasma spray torch 60, the planetary turntable 62 and the overspray wash subsystem 54.

As the planetary turntable 62 rotates, the control 58 operates the robotic controlled wash sprayer 70 of the overspray wash subsystem 54 to wash the workpieces W as they are rotated thereby. The overspray wash subsystem 54 need not operate at each coating pass or revolution of the planetary turntable 62 and may occur, for example for every five to thirty (5-30) revolutions. In this disclosed non-limiting embodiment, the robotic controlled wash sprayer 70 may be located at an angle $\alpha$ of about thirty to three hundred and thirty (30-330) degrees downstream or upstream relative to the plasma spray torch 60. That is, the robotic controlled wash sprayer 70 thereby facilitates removal of the overspray on the workpieces W to maintain operational production speeds.

The integrated plasma spray system is modular to allow for expansion; addresses the fine overspray formed in the process, includes a planetary motion table and quick change load/unload manner for coating of multiple workpieces per run to manage the heat of the plasma process but maintain high plasma gun time on workpieces to facilitate high production volumes.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A plasma spray system, comprising:

a turntable subsystem operable to position a multiple of workpieces on a respective multiple of workpiece mounts about a central axis;

a plasma spray subsystem directed toward said central axis, said plasma spray subsystem operable to respectively plasma spray each of the multiple of workpieces on said turntable subsystem in response to rotation of said respective multiple of workpiece mounts about the central axis; and an overspray wash subsystem positioned relative to the plasma spray subsystem, said overspray wash subsystem operable to respectively wash the multiple of workpieces in response to rotation of said respective multiple of workpiece mounts about the central axis.

2. The system as recited in claim 1, wherein said overspray wash subsystem is positioned relative to said plasma spray subsystem by about thirty to three hundred and thirty (30-330) degrees of said turntable subsystem rotation.

3. The assembly as recited in claim 1, wherein each of said multiple of workpiece mounts are rotatable about a respective axis parallel to said central axis.

4. The assembly as recited in claim 3, further comprising a sun drive that rotates a removable saucer of said turntable subsystem about said central axis and a planetary drive that selectively rotates said multiple of workpiece mounts.

5. The assembly as recited in claim 3, further comprising a deflector located about said central axis and within said multiple of workpiece mounts.

6. The assembly as recited in claim 5, wherein said deflector is multi sided.

7. The assembly as recited in claim 1, further comprising a wall collector adjacent to said turntable subsystem opposite said plasma spray subsystem.

8. The assembly as recited in claim 1, wherein said overspray wash subsystem is operable to wash the multiple of workpieces with dry ice.

9. The system as recited in claim 8, wherein said overspray wash subsystem is positioned relative to said plasma spray subsystem by about thirty to three hundred and thirty (30-330) degrees of said turntable subsystem rotation.

10. The system as recited in claim 1, further comprising a multiple of turntable subsystems.

11. The system as recited in claim 10, wherein said plasma spray subsystem rotates between at least two of said multiple of turntable subsystems.

12. A plasma spray system, comprising:

a turntable subsystem operable to rotate a multiple of workpieces on a respective multiple of workpiece mounts, said turntable subsystem rotatable about a central axis and each of said multiple of workpiece mounts are rotatable about a respective axis;

a plasma spray subsystem operable to plasma spray the multiple of workpieces on said turntable subsystem as said turntable subsystem rotates said multiple of workpieces about said central axis, said plasma spray subsystem arranged to spray in a direction transverse to the central axis; and an overspray wash subsystem operable to wash the multiple of workpieces on said turntable subsystem, said overspray wash subsystem downstream of said plasma spray subsystem with respect to rotation of said turntable subsystem about said central axis.

13. The assembly as recited in claim 12, wherein said overspray wash subsystem is operable to wash the multiple of workpieces with dry ice.

14. The system as recited in claim 12, wherein said plasma spray subsystem rotates between at least two of a multiple of turntable subsystems.

15. The system as recited in claim 1, wherein said overspray wash subsystem is directed toward said central axis and positioned at an angle relative to the plasma spray subsystem.

16. The system as recited in claim 15, wherein said overspray wash subsystem is positioned at an angle relative to the plasma spray subsystem.

17. The system as recited in claim 1, wherein said plasma spray subsystem is directed to spray in a direction transverse to the central axis.

18. The system as recited in claim 17, wherein said overspray wash subsystem is directed to spray in a direction transverse to the central axis.

* * * * *